US008360010B1

(12) United States Patent
Boaldin

(10) Patent No.: US 8,360,010 B1
(45) Date of Patent: Jan. 29, 2013

(54) CALF HANDLING APPARATUS

(76) Inventor: Johnny B. Boaldin, Elkhart, KS (US)

( * ) Notice: Subject to any disclaimer, the term of this patent is extended or adjusted under 35 U.S.C. 154(b) by 0 days.

(21) Appl. No.: 13/271,989

(22) Filed: Oct. 12, 2011

(51) Int. Cl.
*A61D 3/00* (2006.01)

(52) U.S. Cl. ..... 119/735; 119/729

(58) Field of Classification Search ..... 119/512, 119/519, 524, 712, 732–733, 738, 744–747, 119/750–752, 843, 729, 735
See application file for complete search history.

(56) References Cited

U.S. PATENT DOCUMENTS

| | | | | | |
|---|---|---|---|---|---|
| 2,831,458 | A | | 4/1958 | Jones | |
| 2,833,248 | A | | 5/1958 | Meyer et al. | |
| 2,895,451 | A | | 7/1959 | Smith | |
| 2,999,480 | A | | 9/1961 | Sparkman | |
| 3,037,482 | A | * | 6/1962 | Jackson et al. | 119/732 |
| 3,095,858 | A | * | 7/1963 | Bauer | 119/744 |
| 3,135,240 | A | | 6/1964 | Hickman | |
| 3,511,216 | A | * | 5/1970 | George | 119/745 |
| 3,538,890 | A | | 11/1970 | Torell et al. | |
| 3,683,864 | A | * | 8/1972 | Priefert | 119/752 |
| 3,691,998 | A | | 9/1972 | Luinstra | |
| 3,720,187 | A | | 3/1973 | McDonough | |
| 3,777,715 | A | * | 12/1973 | Hill et al. | 119/733 |
| 3,788,280 | A | * | 1/1974 | Van Gilst | 119/737 |
| 3,814,060 | A | | 6/1974 | Swenson | |
| 3,885,527 | A | * | 5/1975 | Maffey et al. | 119/732 |
| 3,960,113 | A | * | 6/1976 | Kratky | 119/723 |
| 4,116,166 | A | | 9/1978 | Gofflot | |
| 4,302,908 | A | | 12/1981 | Parker | |
| 4,312,299 | A | * | 1/1982 | Leiker | 119/732 |
| 4,366,775 | A | * | 1/1983 | Tyquin | 119/512 |
| 4,432,305 | A | * | 2/1984 | Vernese | 119/752 |
| 4,513,690 | A | | 4/1985 | Waldron | |
| 4,771,737 | A | | 9/1988 | Lynch | |
| 4,979,471 | A | * | 12/1990 | Hartshorn | 119/751 |
| 5,179,801 | A | | 1/1993 | Babchuk et al. | |
| 5,197,412 | A | * | 3/1993 | Wade | 119/735 |
| 5,263,438 | A | | 11/1993 | Cummings | |
| 5,626,100 | A | | 5/1997 | Stubbs et al. | |
| 7,784,431 | B2 | | 8/2010 | Hatfield et al. | |
| 2005/0132978 | A1 | | 6/2005 | Bentz | |
| 2006/0169220 | A1 | | 8/2006 | Kerns | |
| 2011/0079184 | A1 | | 4/2011 | Mollhagen | |

* cited by examiner

*Primary Examiner* — Rob Swiatek
*Assistant Examiner* — Danielle Clerkley
(74) *Attorney, Agent, or Firm* — Kenneth H. Jack; Davis & Jack, LLC

(57) ABSTRACT

A calf handling apparatus incorporating a base having a forward end, a first wall fixedly attached to and extending upwardly from the base's forward end, the first wall having a lateral side and an oppositely lateral side, and the first wall including a pivoting head gate jaw; a second wall fixedly attached to the base, the second wall extending rearwardly from the first wall's lateral side; and a third wall, the third wall being hingedly attached to the first wall's oppositely lateral side for movement between calf holding and calf releasing positions, the third wall extending rearwardly from the first wall's oppositely lateral side upon movement to the calf holding position, the third wall being displaced oppositely laterally from the calf holding position upon movement to the calf releasing position.

12 Claims, 3 Drawing Sheets

CALF HANDLING APPARATUS

FIELD OF THE INVENTION

This invention relates to apparatus and assemblies for handling and treating livestock. More particularly, this invention relates to head gate and squeeze chute combinations which are adapted for receiving and holding livestock during livestock treating procedures.

BACKGROUND OF THE INVENTION

Cattle squeeze chute and head gate assemblies commonly incorporate cattle squeezing side walls which pivot at their lower ends. Such assemblies also commonly incorporate head gate jaws which inwardly pivot for cattle neck holding and which outwardly pivot in order to form an open cattle releasing doorway. Such common squeeze chute and head gate combinations undesirably form and present a blank or dead end channel which cattle hesitantly enter, and such combinations are typically excessively mechanically complex and are excessively bulky.

The instant inventive calf handling apparatus solves or ameliorates the problems, defects, and deficiencies discussed above, by providing a forwardly pivoting squeeze chute wall which multiply functions as a calf holding member, as a calf guiding "V" channel defining member, and as a calf releasing member.

BRIEF SUMMARY OF THE INVENTION

A first structural component of the instant inventive calf handling apparatus comprises a base having a forward end. In a preferred embodiment, the base comprises a rectangular metal platform. Suitably, the base may comprise a steel weldment configured as a ladder frame or chassis, such weldment having a sheet steel upper floor surface welded thereto. Also in the preferred embodiment, a plurality of hoof treads configured as laterally extending ridges may be welded to the upper surface of the base.

A further structural component of the inventive calf handling apparatus comprises a first wall which is preferably fixedly attached to and extends upwardly from the base's forward end, the first wall having a lateral side and an oppositely lateral side. Necessarily, the apparatus's first wall comprises and incorporates head gate means which are suitable for receiving the head and neck of a calf, and for securely holding the calf. In a preferred embodiment, the incorporated head gate means comprises a vertically extending fixed jaw which is laterally paired with a vertically extending pivoting jaw, the pivoting jaw being associated with releasable latching means which are adapted for holding the pivoting jaw at a calf neck holding position upon movement of the pivoting jaw toward the fixed jaw, and for alternatively releasing the calf's neck by permitting counter-pivoting movement of the pivoting jaw.

A further structural component of the instant calf handling apparatus comprises a second wall which is fixedly attached and extends upwardly from the base, and which further extends rearwardly from the first wall's lateral side. In a preferred embodiment, the second wall is rigidly and immovably attached in relation to the first wall and the base. Preferably, the base is sized so that it includes a stabilizing section which extends laterally from the lower end of the second wall. Also in the preferred embodiment, the second wall has a canted orientation with respect to the base so that the second wall may function as one of the arms of a calf guiding "V" channel.

A further structural component of the instant inventive calf handling apparatus comprises a third wall which is preferably hingedly attached to the first wall's oppositely lateral side for movement of the third wall between calf holding, "V" channel forming, and calf releasing positions. Second releasable latching means are preferably associated with the third wall's rearward end, the second releasable latching means being adapted for, upon pivoting movement of the third wall toward the calf holding position, resisting any counter-pivoting motions of the third wall away from such position and toward the "V" channel forming positions. In the preferred embodiment, the second releasable latching means are adapted for selectively releasing the third wall for releasing a calf or for the forming a calf guiding "V" channel.

In use of the instant inventive calf handling apparatus, and assuming the provision of preferred structures, as described above, the third wall may initially be pivoted to its "V" channel forming position. Suitably, a curved string of fence or stock panels extending to the rearward end of the second wall may be provided and attached, and a calf may be easily and conveniently herded along such panel string toward the rear opening of the calf handling apparatus. Upon meeting the rearwardly opening "V" channel formed by the apparatus's second and third walls, such calf advantageously does not hesitate to continue moving forwardly toward the head gate which is positioned at the vertex of the "V" channel. Upon reaching the vertex of the "V", the head gate means may be operated simultaneously with imposition of pivoting movement of the third wall toward the calf holding position. Such simultaneous operations advantageously cause the apparatus to hold the calf at its torso and at its neck. First, releasable latching means associated with a head gate may provide for continued secured holding of the calf's neck while second releasable attaching means associated with the third wall may provide continued secured holding of the calf's torso.

Following processing and treatment of the calf (such as administering innoculations), the head gate may be released, and the third wall may be hingedly and pivotally moved oppositely laterally and away from the calf and beyond the "V" channel forming position. Upon such head gate release and third wall oppositely lateral pivoting, the calf advantageously perceives that it no longer occupies a confined and closed ended channel. Thereafter, the calf naturally backs away, withdrawing its head from the head gate and exits the apparatus in oppositely laterally direction.

References to calves made herein and in the claims below, are considered to refer to livestock animals in general, including sheep and goats, and without any restrictive reference to the age or size of the animal.

Accordingly, objects of the instant invention include the provision of a calf or other animal handling apparatus which incorporates structures, as described above, and which arranges those structures in relation to each other in the manners described above for the performance of beneficial functions, as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
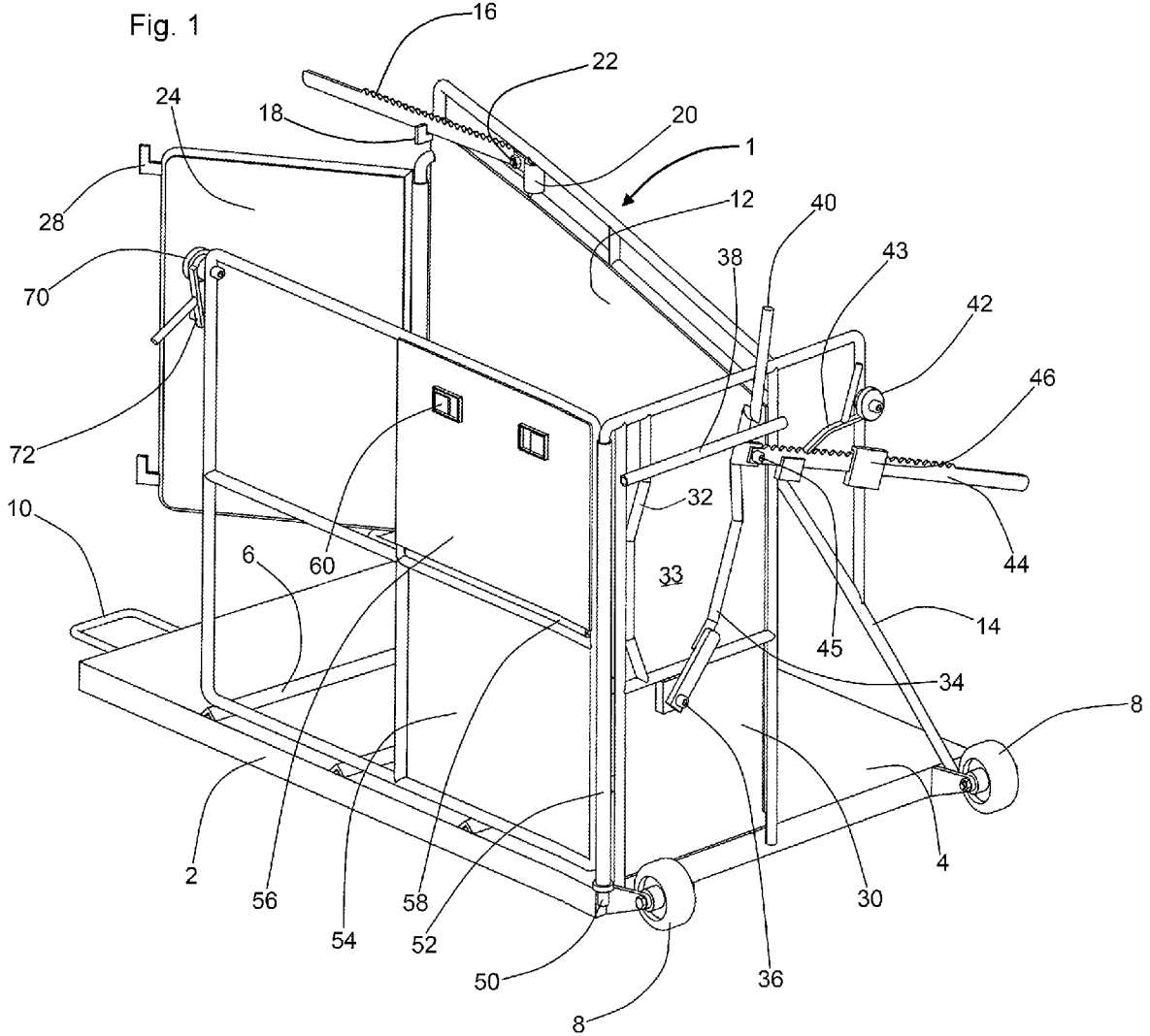
FIG. 1 is a perspective view of a preferred embodiment of the instant inventive calf handling apparatus.

Referring now to the drawings, and in particular to Drawing FIG. 1, a preferred embodiment of the instant inventive calf handling apparatus is referred to generally by Reference Arrow 1. The apparatus 1 preferably has a rectangular base or foundation 2. Rolling means in the form of wheels 8 are preferably mounted at the forward end of the base 2, and handle means 10 are preferably mounted oppositely from the wheels 8. In use of the wheels 8 in combination with the handle means 10, an operator may stand at the rearward end of the apparatus 1 and may grasp both handles 10, raising the rearward end of the apparatus 1 upwardly. Upon such upward raising, wheels 8 come into contact with the ground or floor, and allow the entire apparatus 1 to be rollably pushed or pulled along ground or floor surfaces. Hoof treads 6 are preferably fixedly welded to the upper surface of the base 2 for enhancement of traction of cattle standing upon the base 2.

Referring further to FIG. 1, a first wall 30 is preferably provided, the first wall 30 being fixedly attached to and extending upwardly from the forward end of the base 2. Head gate means are preferably incorporated into and as a part of the first wall 30, the head gate means preferably comprising an oppositely lateral fixed jaw 32 and a lateral pivot jaw 34 having a handle 40 at its upper end. Jaw 34 is preferably pivotally attached to the first wall 30 by pivot joint 36 and a jaw capturing slide bar 38 is provided. First releasable latching means are preferably mechanically associated with the pivoting jaw 34, such means preferably comprising a toothed bar 44 and latch pawl 43 combination. Spring means 42 normally rotatably move the latch pawl 43 into engagement with the teeth of the toothed bar 44 and slides 46 guide lateral extending and retracting movements of the toothed bar 44. Upon lateral opening movement of the pivoting jaw 34 away from the fixed jaw 32, a calf head and neck receiving space 33 is advantageously expanded.

Figure 3:
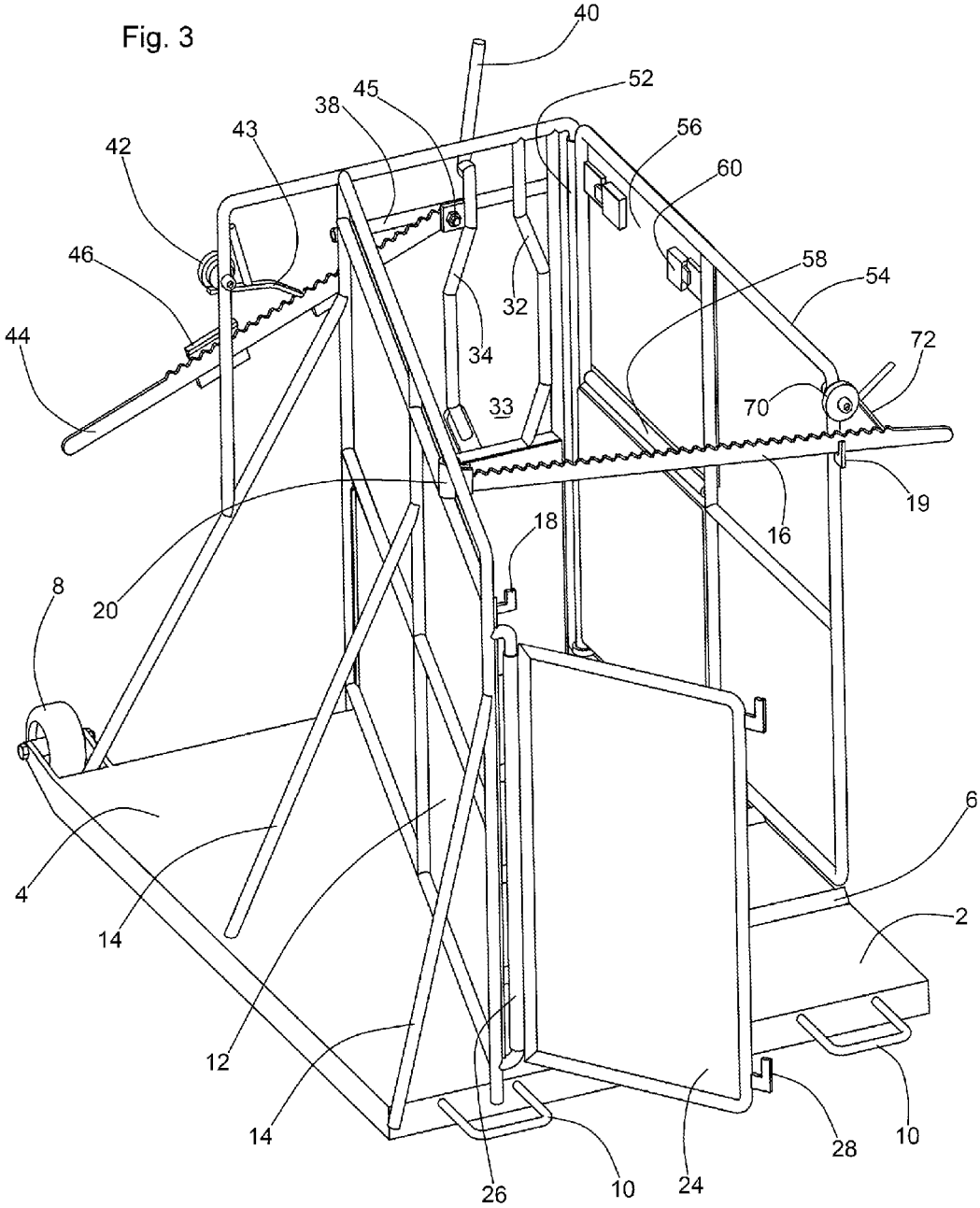
FIG. 3 presents an alternative redepiction of the structure of FIG. 1, the view of FIG. 3 showing the apparatus from a rearward perspective.

Referring to FIG. 3, upon entry of a calf's head into and through space 33, the operator may pull handle 40 in the oppositely laterally direction, causing the pivoting jaw 34 to move oppositely laterally toward the depicted contracted calf head securing position. During such space contracting motion, the toothed bar 44 pivots at pivot joint 45 and slidably moves along guides 46, and during such motion, the toothed bar 44 is continuously releasably latched by latch pawl 43 and spring means 42.

Figure 2:
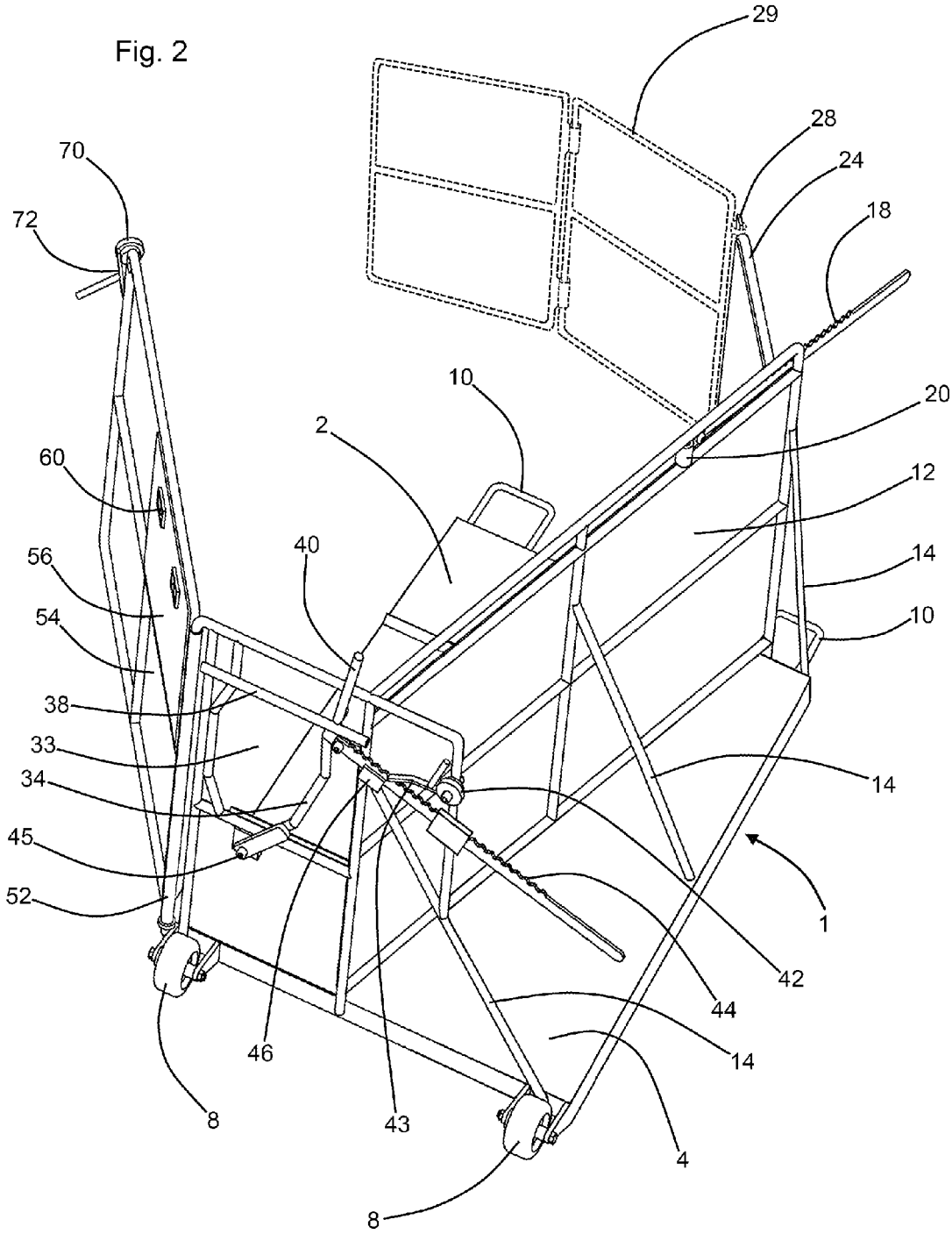
FIG. 2 redepicts the structure of FIG. 1, the drawing of FIG. 2 showing an alternative orientation.

Referring to FIG. 2, a second wall 12 is preferably fixedly and rigidly attached to the base 2, the forward end of the second wall 12 preferably meeting the lateral end of the first wall 30. In the preferred embodiment, the second wall 12 is preferably positioned with respect to the base 2 so that a stabilizing portion 4 of the base 2 extends laterally from the second wall 12. Also in the preferred embodiment, the second wall 12 is preferably angularly canted with respect to the longitudinal axis of the base 2 so that the second wall 12 may advantageously function as one of the arms of a call guiding "V" channel. Braces 14 are preferably provided so that, upon impacts of calves against the oppositely lateral face of the second wall 12, the second wall 12 will not excessively flex in the lateral direction.

Referring again to FIG. 1, the instant inventive calf handling apparatus 1 preferably further comprises a third wall 54. In the preferred embodiment, the forward end of the third wall 54 is hingedly attached at the oppositely lateral side of the first wall 30. Preferably, such hinged attachment comprises a fixed pin and pivoting sleeve joint, the pin preferably comprising a tubular vertical support member 50 of the first wall 30. Tube 50 is received within sleeve 52 which is fixedly welded at the forward end of third wall 54.

In operation, referring further to FIG. 3, the pivoting third wall 54 may move in the lateral direction to the depicted calf holding position. Alternatively, referring further to FIG. 2, the pivoting third wall 54 may pivot oppositely laterally to the depicted "V" channel forming position and toward a calf releasing position.

Second releasable latching means are preferably operatively associated both with the second wall 12 and with the third wall 54, such means preferably comprising a toothed bar 16 and spring biased latch pawl combination 70 and 72. While such latching means is not in use, the toothed bar 16 may be pivoted rearwardly about pivot joints 20 and 22 for resting storage upon hook bracket 18. Alternatively, referring to FIG. 3, the tooth bar 16 may be pivotally moved forwardly about pivot joint 20 for sliding engagement with hook bracket 19 and for latching engagement with spring biased latch pawl 70,72.

Referring to FIG. 2, in use of the instant inventive calf handling apparatus 1, latch pawl 43 may be disengaged from toothed bar 46, and the pivoting head gate jaw 34 may be laterally pivotably moved in order to expend space 33 for receipt of a calf's head and neck. Upon such head gate opening pivoting motion, the operator may release the handle of latch pawl 43, allowing the mechanism's spring 42 to re-engage the pawl against the teeth of toothed bar 44. Thereafter, the third wall 54 may be manually pivotally moved to its depicted angular orientation. At such orientation, the third wall 54 in combination with the canted second wall 12 advantageously form a calf guiding "V" channel. Referring further simultaneously to FIG. 3, a fence connector panel 24 may advantageously be pivotally attached by hinge 26 to the rearward end of the second wall 12. A curved series of calf guiding fence panels 29 may extend rearwardly from the rearward edge of panel 24, such fence panels being attached by attachment brackets 28.

As a calf to be processed within the instant inventive calf handling apparatus 1 may be herded along fence panels 29 and 24, such calf willingly enters the opened "V" of the "V" channel, and proceeds to extend its head through opening 33 of the head gate. Thereafter, referring further to FIG. 3, the operator may pivotally laterally move the third wall 54 while oppositely laterally pivoting the head gate's pivoting jaw 34 to secure the calf's head and neck and to squeeze the calf's torso between walls 12 and 54. The second releasable latching means 16,70,72 may be utilized for securely holding the third wall 54 in the calf holding position depicted in FIG. 3. In order to assist in treatment of such calf (through administration of innoculations, for example), a pivoting access panel 56 may be advantageously hingedly attached to the third wall 54 by means of a pin and hinge sleeve 58. Releasable latches 60 are preferably provided for alternatively allowing opening of the panel 56 and securing the panel 56 at its closed position.

Referring to all figures, upon completion of processing of the calf captured within the calf handling apparatus 1, as described above, latch pawl 43 may be released for releasing lateral pivoting motion of pivoting jaw 34, and latch pawl 72 may be released for releasing oppositely lateral pivoting motion of the third wall 54. Such oppositely lateral pivoting of the third wall 54 may continue beyond the "V" channel configuration depicted in FIG. 2 to extend the third wall 54 substantially perpendicularly from the base 2 and parallel with the first wall 30. Upon such releasing pivoting motion of the third wall 54, such calf typically ceases to observe that it is contained or captured within a defined channel. Upon the calf's sense of an open space in the oppositely lateral direction, the calf naturally backs away from the head gate of the first wall 30, and exits the apparatus 1 in the oppositely lateral direction.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A calf handling apparatus comprising:

(a) a base having a forward end;

(b) a first wall fixedly attached to and extending upwardly from the base's forward end, the first wall having a lateral side and an oppositely lateral side, the first wall's lateral and oppositely lateral sides being immovably mounted with respect to each other, and the first wall comprising head gate means; the head gate means comprising lateral and oppositely lateral neck contacting jaws, said jaws being adapted for moving with respect to each other between calf neck securing and calf neck releasing positions, (c) a second wall fixedly attached to the base, the second wall extending rearwardly from the first wall's lateral side; and (d) a third wall, the third wall being directly hingedly attached to the first wall's oppositely lateral side for, while the lateral and oppositely lateral neck contacting jaws are positioned at the calf neck securing position, moving from a calf receiving or releasing position to a calf holding position, the third wall extending rearwardly from the first wall's oppositely lateral side upon the movement to the calf holding position, the third wall being displaced oppositely laterally from the calf holding position upon the movement to the calf receiving or releasing position; the head gate means comprising a fixed neck contacting jaw and a pivoting neck contacting jaw.

2. The calf handling apparatus of claim 1 wherein the base comprises a stabilizing section, the base's stabilizing section extending laterally from the second wall.

3. The calf handling apparatus of claim 2 further comprising rolling means, the rolling means being fixedly attached to the base.

4. The calf handling apparatus of claim 3 further comprising handle means, the handle means being fixedly attached to the base, and being positioned oppositely from the rolling means.

5. The calf handling apparatus of claim 4 further comprising a plurality of hoof treads, each hoof tread being fixedly attached to and extending upwardly from the base.

6. The calf handling apparatus of claim 1 wherein the head gate means further comprise releasable latching means connected operatively to the pivoting neck contacting jaw, the releasable latching means being adapted for, upon movement of the pivoting neck contacting jaw toward the fixed neck contacting jaw, resisting movement of the pivoting neck contacting jaw away from the fixed neck contacting jaw.

7. The calf handling apparatus of claim 6 wherein the releasable latching means comprises a tooth bar and spring biased pawl combination.

8. The calf handling apparatus of claim 1 further comprising releasable latching means connected operatively to the second and third walls, the releasable latching means being adapted for, upon the movement of the third wall to the calf holding position, resisting movement of the third wall toward the calf releasing position.

9. The calf handling apparatus of claim 1 wherein the second wall is angularly canted with respect to the base so that, upon the movement of the third wall toward the calf releasing position, the second and third walls form a calf guiding "V" channel.

10. The calf handling apparatus of claim 9 wherein the calf guiding "V" channel has a vertex, the first wall and the head gate means being positioned at the vertex.

11. A calf handling apparatus comprising:

(a) a base having a forward end;

(b) a first wall fixedly attached to and extending upwardly from the base's forward end, the first wall having a lateral side and an oppositely lateral side, the first wall's lateral and oppositely lateral sides being immovably mounted with respect to each other, and the first wall comprising head gate means; the head gate means comprising lateral and oppositely lateral neck contacting jaws, said jaws being adapted for moving with respect to each other between calf neck securing and calf neck releasing positions, (c) a second wall fixedly attached to the base, the second wall extending rearwardly from the first wall's lateral side;

(d) a third wall, the third wall being directly hingedly attached to the first wall's oppositely lateral side for, while the lateral and oppositely lateral neck contacting jaws are positioned at the calf neck securing position, moving from a calf receiving or releasing position to a calf holding position, the third wall extending rearwardly from the first wall's oppositely lateral side upon the movement to the calf holding position, the third wall being displaced oppositely laterally from the calf holding position upon the movement to the calf receiving or releasing position; and (e) releasable latching means connected operatively to the second and third walls, the releasable latching means being adapted for, upon the movement of the third wall to the calf holding position, resisting movement of the third wall toward the calf releasing position; the releasable latching means comprising a toothed bar and spring biased latch pawl combination.

12. The calf handling apparatus of claim 11 wherein the third wall comprises a pivoting access panel.

* * * * *